US008614700B2

(12) United States Patent
Yu

(10) Patent No.: US 8,614,700 B2
(45) **Date of Patent: *Dec. 24, 2013**

(54) VOLTAGE LEVEL SHIFTER

(75) Inventor: Jian-Shen Yu, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 141 days.

This patent is subject to a terminal disclaimer.

(21) Appl. No.: 13/099,462

(22) Filed: May 3, 2011

(65) Prior Publication Data

US 2011/0204954 A1 Aug. 25, 2011

Related U.S. Application Data

(63) Continuation of application No. 11/461,467, filed on Aug. 1, 2006, now Pat. No. 7,995,049.

(30) Foreign Application Priority Data

Apr. 19, 2006 (TW) ..... 95114010 A

(51) Int. Cl.
*G09G 5/00* (2006.01)

(52) U.S. Cl.
USPC ..... 345/211; 345/92; 345/100; 345/204; 377/64; 377/69; 377/70; 377/72; 327/241; 327/333

(58) Field of Classification Search
USPC ..... 345/92, 100, 204, 211; 377/64, 69, 70, 377/72; 327/241, 333
See application file for complete search history.

(56) References Cited

U.S. PATENT DOCUMENTS

| | | | | |
|---|---|---|---|---|
| 5,223,751 | A | 6/1993 | Simmons et al. | |
| 5,493,245 | A | 2/1996 | Kao et al. | |
| 5,701,136 | A | 12/1997 | Huq et al. | |
| 6,037,720 | A | 3/2000 | Wong et al. | |
| 6,087,880 | A | 7/2000 | Takagi | |
| 6,426,652 | B1 | 7/2002 | Greenhill et al. | |
| 6,922,095 | B2 | 7/2005 | Chiu | |
| 7,071,669 | B2 | 7/2006 | Morita | |
| 7,180,356 | B2 | 2/2007 | Kanbara et al. | |
| 7,463,072 | B2 | 12/2008 | Kim et al. | |
| 7,511,551 | B2 * | 3/2009 | Lee | 327/333 |
| 2003/0020520 | A1 | 1/2003 | Miyake et al. | |
| 2004/0021496 | A1 | 2/2004 | Shin | |
| 2004/0084696 | A1 * | 5/2004 | Chiu | 257/200 |
| 2004/0253781 | A1 | 12/2004 | Kimura et al. | |
| 2005/0088217 | A1 | 4/2005 | Lee | |
| 2006/0006908 | A1 | 1/2006 | Chung | |

OTHER PUBLICATIONS

Taiwan Notice of Allowance mailed Oct. 31, 2011.

* cited by examiner

*Primary Examiner* — Gregory J Tryder
(74) *Attorney, Agent, or Firm* — McClure, Qualey & Rodack, LLP

(57) ABSTRACT

A voltage level shifter formed by single-typed transistors comprises two input terminals, two power supply terminals, a plurality of thin-film transistors, and an output terminal. Another voltage level shifter formed by single-typed transistors comprises two input terminals, an output terminal, two power supply terminals, two input units, a first thin-film transistor, a disable unit, a feedback unit, and a second thin-film transistor. The voltage level shifters are formed by single-typed TFTs. When integrating the voltage level shifters into a substrate of a TFT display, the manufacturing processes are simplified. Besides, power is saved.

16 Claims, 9 Drawing Sheets

VOLTAGE LEVEL SHIFTER

CROSS-REFERENCES TO RELATED APPLICATIONS

This application is a continuation of U.S. application Ser. No. 11/461,467, filed Aug. 1, 2006, which claims the benefit from the priority of Taiwan Patent Application No. 095114010 filed on Apr. 19, 2006, the disclosures of which are incorporated by reference herein in their entirety.

BACKGROUND OF THE INVENTION

1. Field of the Invention

The present invention relates to a voltage level shifter, and more particularly, to a voltage level shifter formed by single-typed thin-film transistors.

2. Descriptions of the Related Art

Recently, thin-film transistor liquid crystal displays (TFT LCDs) are widely applied in personal computer monitors, televisions, cellular phones, digital cameras, and other electronic appliances. A TFT array is scanned according to a clock signal to activate pixels in turns. Since a high voltage level of the clock signal is required while the TFT array is scanned, the clock signal with a low voltage level has to be transferred to the high voltage level by a peripheral driving circuit, such as a voltage level shifter, and then provided to the TFT array.

FIG. 1 shows the circuit of one of conventional voltage level shifters, which comprises NMOS TFTs 101, 103, and PMOS TFTs 105, 107. Due to the coexistence of NMOS TFTs and PMOS TFTs, multiple doping MOS processes are generally necessary. This increases processing steps when integrating the voltage level shifter into a substrate of a TFT display, and manufacture cost increases.

One of the drawbacks of the conventional voltage level shifter is high manufacture cost. Therefore, it is desired in the industrial field that a voltage level shifter formed by single-typed TFTs to reduce manufacture cost.

SUMMARY OF THE INVENTION

The present invention, in one aspect, relates to a voltage level shifter formed by single-typed TFTs. In one embodiment, the voltage level shifter comprises a first input terminal, a second input terminal, a first power supply terminal, a second power supply terminal, a first TFT, a second TFT, a third TFT, a fourth TFT, a fifth TFT, a sixth TFT, and an output terminal. The first input terminal is configured to receive a first input signal. The second input terminal is configured to receive a second input signal. The first TFT, the second TFT, the third TFT, the fourth TFT, the fifth TFT, and the sixth TFT comprise a gate, a source, and a drain, respectively. The drain of the first TFT is electrically coupled to the first input terminal and the gate of the first TFT. The source of the second TFT is electrically coupled to the first power supply terminal. The gate of the second TFT is electrically coupled to the source of the first TFT. The source of the third TFT is electrically coupled to the drain of the second TFT. The drain of the third TFT is electrically coupled to the second power supply terminal. The source of the fourth TFT is electrically coupled to the gate of the second TFT. The drain of the fourth TFT is electrically coupled to the second power supply terminal. The gate of the fourth TFT is electrically coupled to the gate of the third TFT. The gate and the drain of the fifth TFT are electrically coupled to the second input terminal. The source of the fifth TFT is electrically coupled to the gate of the fourth TFT. The gate of the sixth TFT is electrically coupled to the first input terminal. The drain of the sixth TFT is electrically coupled to the second power supply terminal. The source of the sixth TFT is electrically coupled to the source of the fifth TFT. The output terminal is electrically coupled to the source of the third TFT.

In another aspect, the present invention relates to a voltage level shifter formed by single-typed TFTs. In one embodiment, the voltage level shifter comprises a first input terminal, a second input terminal, an output terminal, a first power supply terminal, a second power supply terminal, a first input unit, a second input unit, a first TFT, a disable unit, a feedback unit, and a second TFT. The first TFT and second TFT comprise a gate, a source, and a drain, respectively. The first input unit is configured to receive a first input signal via the first input terminal so as to output a first switching control signal. The second input unit is configured to receive a second input signal via the second input terminal so as to output a second switching control signal. The gate of the first TFT is electrically coupled to the first input unit and receives the first switching control signal. The drain of the first TFT is electrically coupled to the output terminal. The source of the first TFT is electrically coupled to the first power supply terminal. The disable unit is electrically coupled to the first input unit, the second input unit, the first TFT, and the second power supply terminal so as to control the first TFT disable. The feedback unit transmits a feedback signal to the first input unit and the disable unit in responding to an output signal of the output terminal. The gate of the second TFT is electrically coupled to the second input unit and receives the second switching control signal. The source of the second TFT is electrically coupled to the output terminal. The drain of the second TFT is electrically coupled to the second power supply terminal.

The present invention discloses voltage level shifters formed by single-typed TFTs. When integrating the voltage level shifters into a substrate of a TFT display, the manufacturing processes are simplified. Besides, power is saved.

These aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the present invention and, together with the written description, serve to explain the principles of the present invention. Wherever possible, the same reference numbers are used throughout the drawings to refer to the same or like elements of an embodiment, and wherein.

DESCRIPTION OF THE PREFERRED EMBODIMENT

The present invention is more particularly described in the following examples that are intended as illustrative only since numerous modifications and variations therein will be apparent to those skilled in the art. Various embodiments of the present invention are now described in detail.

Figure 1:
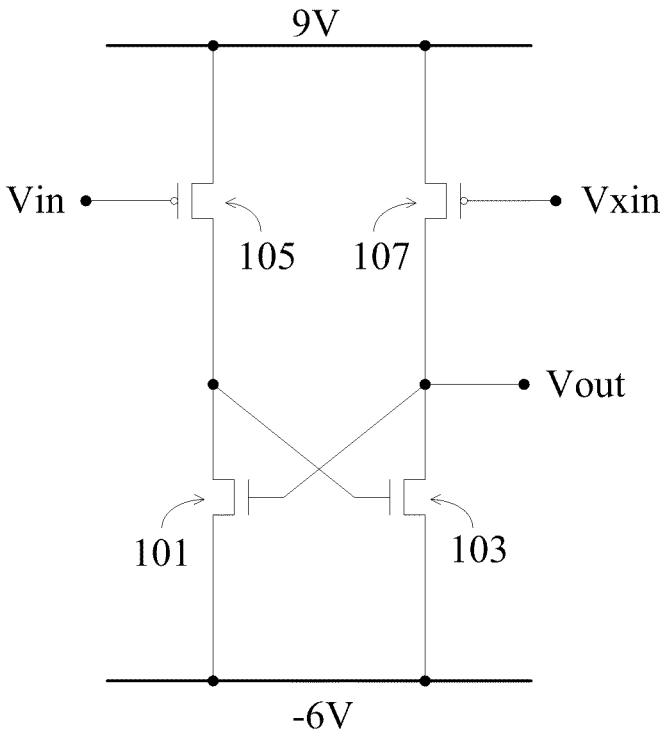
FIG. 1 (prior art)
FIG. 1 illustrates a circuit of a conventional voltage level shifter.
Figure 2A:
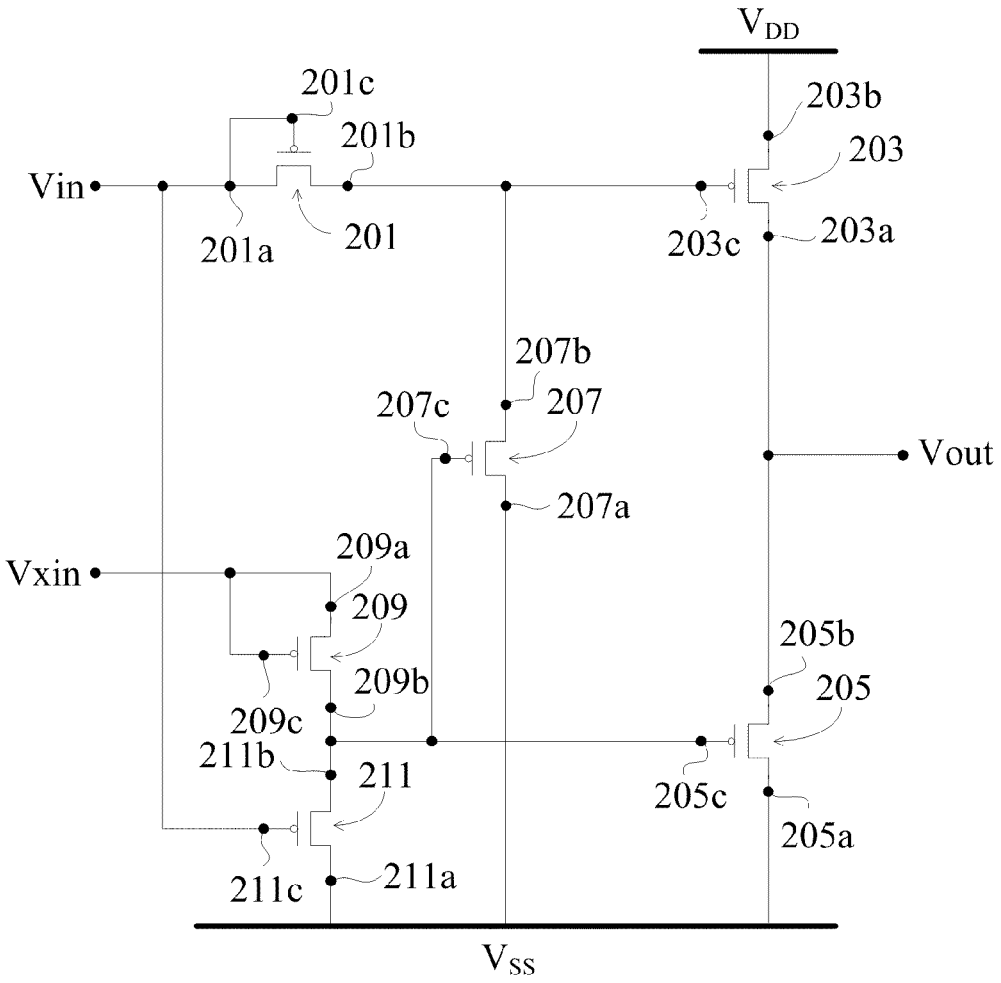
FIG. 2A illustrates a first embodiment of the present invention.

FIG. 2A shows a first embodiment of the present invention which comprises a first input terminal Vin, a second terminal Vxin, a first power supply terminal $V_{DD}$, a second power supply terminal $V_{SS}$, a first TFT 201, a second TFT 203, a third TFT 205, a fourth TFT 207, a fifth TFT 209, a sixth TFT 211, and an output terminal Vout. The first input terminal Vin is configured to input a first input signal and the second input terminal Vxin is configured to receive a second input signal, wherein the first input signal and the second input signal are complementary. In other words, a device (not shown) is configured to generate the first input signal and the second input signal to the first input terminal Vin and the second terminal Vxin, respectively. The first input terminal Vin and the second input terminal Vxin are configured to receive the first input signal and the second input signal, and to transmit the first input signal and the second input signal. The output terminal Vout outputs an output signal. The first TFT 201, second TFT 203, third TFT 205, fourth TFT 207, fifth TFT 209, and sixth TFT 211 are P-type in the first embodiment. Those skilled in the art can easily realize that N-type TFTs are also available. Moreover, the materials of the TFTs, such as amorphous silicon, poly-crystal silicon, micro-crystal silicon, single-crystal silicon, or combinations thereof, and the formations of the TFTs, such as top gate TFTs, bottom gate TFTs, or the like are not a limitation to the present invention. The connections among these elements are described below.

The drain 201*a* of the first TFT 201 is electrically coupled to the first input terminal Vin and the gate 201*c* thereof. The source 203*b* of the second TFT 203 is electrically coupled to the first power supply terminal $V_{DD}$. The gate 203*c* of the second TFT 203 is electrically coupled to the source 201*b* of the first TFT 201. The source 205*b* of the third TFT 205 is electrically coupled to the drain 203*a* of the second TFT 203. The drain 205*a* of the third TFT 205 is electrically coupled to the second power supply terminal $V_{SS}$. The source 207*b* of the fourth TFT 207 is electrically coupled to the gate 203*c* of the second TFT 203. The drain 207*a* of the fourth TFT 207 is electrically coupled to the second power supply terminal $V_{SS}$. The gate 207*c* of the fourth TFT 207 is electrically coupled to the gate 205*c* of the third TFT 205. The gate 209*c* and the drain 209*a* of the fifth TFT 209 are electrically coupled to the second input terminal Vxin. The source 209*b* of the fifth TFT 209 is electrically coupled to the gate 207*c* of the fourth TFT 207. The gate 211*c* of the sixth TFT 211 is electrically coupled to the first input terminal Vin. The drain 211*a* of the sixth TFT 211 is electrically coupled to the second power supply terminal $V_{SS}$. The source 211*b* of the sixth TFT 211 is electrically coupled to the source 209*b* of the fifth TFT 209. The output terminal Vout is electrically coupled to the source 205*b* of the third TFT 205.

Figure 2B:
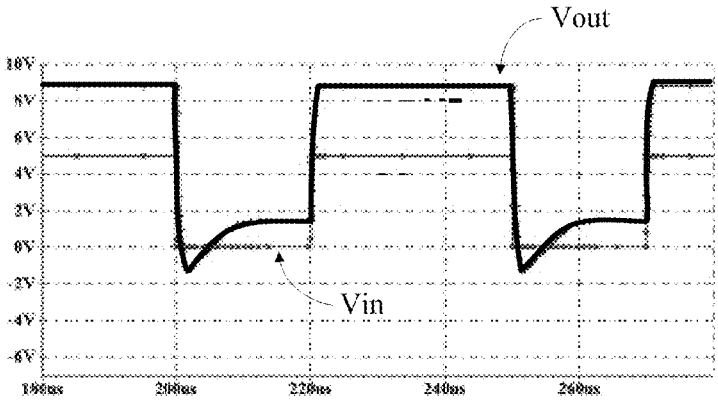
FIGS. 2B, 2C, and 2D illustrate waveforms of an input terminal and an output terminal of the first embodiment of the present invention.
Figure 2C:
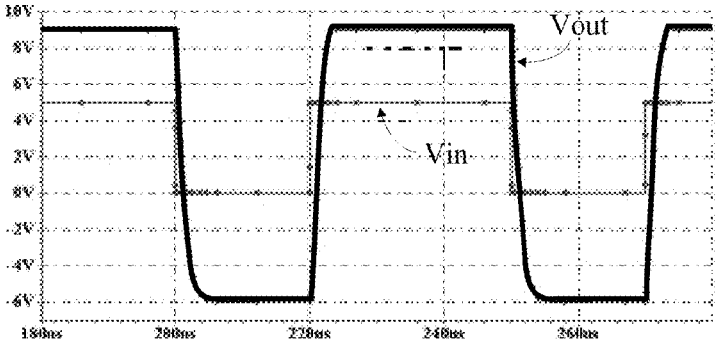
Figure 2D:
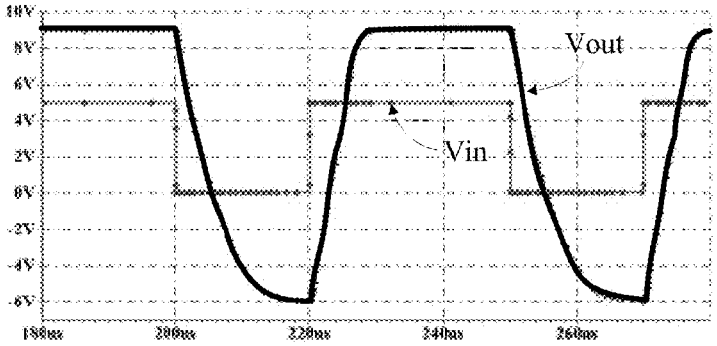

FIGS. 2B, 2C, and 2D show simulation voltage versus time waveforms of the first input terminal Vin and the output terminal Vout under three different TFT threshold voltages, respectively. FIG. 2B shows the waveforms under a first threshold voltage, substantially −1V, FIG. 2C shows the waveforms under a second threshold voltage, substantially −2.5V, and FIG. 2D shows the waveforms under a third threshold voltage, substantially −4V. Meanwhile, the simulation conditions for deriving the waveforms in FIGS. 2B, 2C, and 2D are that: the first power supply terminal $V_{DD}$ is substantially equal to −6V, the second power supply terminal $V_{SS}$ is substantially equal to 9V, the first input terminal Vin swings from about 0V to about 5V, the electron mobility of the PMOS TFTs is about 60 $cm^2$/Vsec, and an output load has about 20 pF capacitance.

As shown in FIG. 2B, the low level of the output terminal Vout is far apart from the voltage level of the first power supply $V_{DD}$, but the high level of the output terminal Vout is close to the voltage level of the second power supply $V_{SS}$ when the threshold voltage is about −1V. As shown in FIG. 2C, the low level and high level of the output terminal Vout are more acceptable when the threshold voltage of TFT is about −2.5V. As shown in FIG. 2D, although the low level of the output terminal Vout can reach the voltage level of the first power supply $V_{DD}$, it takes approximately 20 μs, and the rising time of the output signal is longer when the threshold voltage of TFT is about −4V.

Figure 3A:
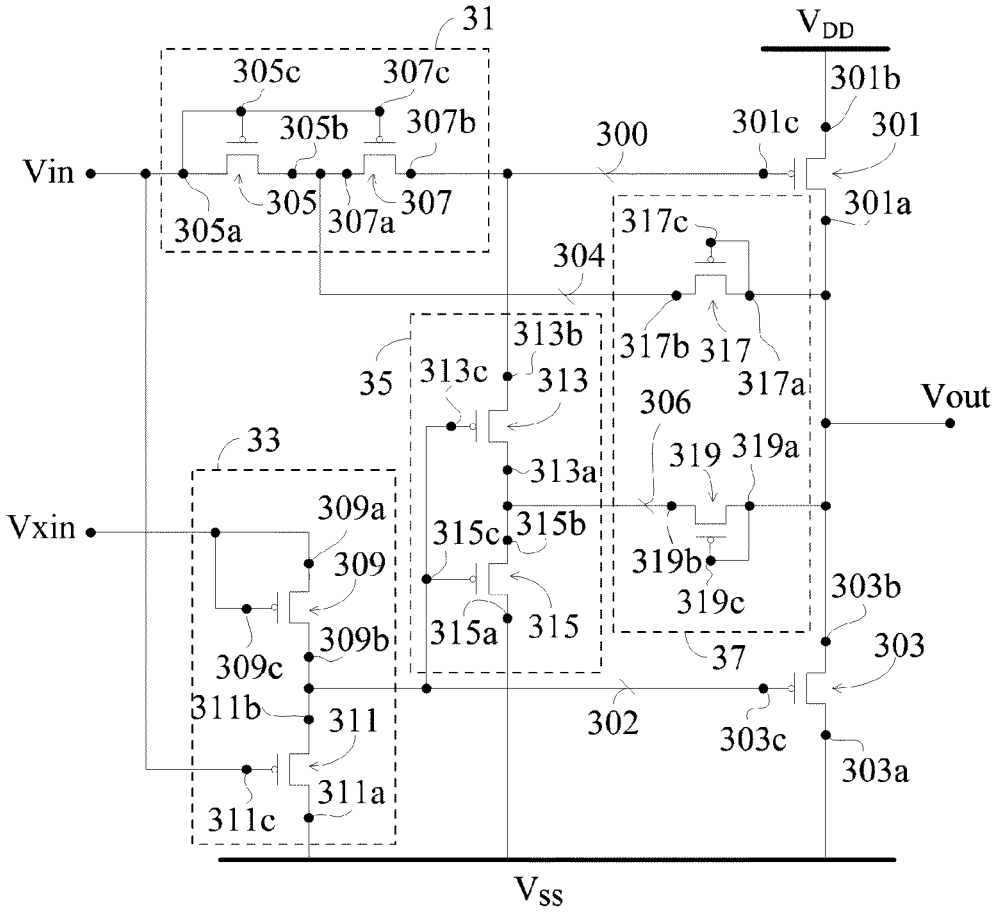
FIG. 3A illustrates a second embodiment of the present invention.

FIG. 3A shows a second embodiment of the present invention, which comprises a first input terminal Vin, a second input terminal Vxin, an output terminal Vout, a first power supply terminal $V_{DD}$, a second power supply terminal $V_{SS}$, a first input unit 31, a second input unit 33, a first TFT 301, a disable unit 35, a feedback unit 37, and a second TFT 303. The first input terminal Vin is configured to input a first input signal. The second input terminal Vxin is configured to input a second input signal. The output terminal Vout is configured to output an output signal. The first input signal and the second input signal are complementary, and the output signal of the output terminal Vout and the first input signal are substantially in phase. The connections among these elements are described below.

The first input unit 31 receives the first input signal via the first input terminal Vin, and outputs a first switching control signal 300. The second input unit 33, electrically coupled to the second power supply terminal $V_{SS}$, receives the second input signal via the second input terminal Vxin, and outputs a second switching control signal 302. The gate 301*c* of the first TFT 301, electrically coupled to the first input unit 31, receives the first switching control signal 300. The drain 301*a* of the first TFT 301 is electrically coupled to the output terminal Vout. The source 301*b* of the first TFT 301 is electrically coupled to the first power supply terminal $V_{DD}$. The disable unit 35, electrically coupled to the first input unit 31, the second input unit 33, the first TFT 301, and the second power supply terminal $V_{SS}$, receives the second switching control signal 302 and disables the first TFT 301. In other words, the disable unit 35 can control the first TFT 301 to disable (namely turned off). The feedback unit 37 respectively transmits feedback signals 304 and 306 to the first input unit 31 and the disable unit 35 in response to the output signal of the output terminal Vout. The gate 303*c* of the second TFT 303, electrically coupled to the second input unit 33, receives the second switching control signal 302. The source 303*b* of the second TFT 303 is electrically coupled to the output terminal Vout. The drain 303*a* of the second TFT 303 is electrically coupled to the second power supply terminal $V_{SS}$. In other words, the second TFT 303 receives the second switching control signal 302.

The first input unit 31 comprises a third TFT 305 and a fourth TFT 307. The second input unit 33 comprises a fifth TFT 309 and a sixth TFT 311. The disable unit 35 comprises a seventh TFT 313 and an eighth TFT 315. The feedback unit 37 comprises a ninth TFT 317 and a tenth TFT 319. All the TFTs included in the second embodiment are P-type. Those skilled in the art can easily realize that N-type TFTs are also available. The materials of the TFTs, such as amorphous silicon, poly-crystal silicon, micro-crystal silicon, single-crystal silicon, or combinations thereof, and the formations of the TFTs, such as top gate TFTs, bottom gate TFTs, or the like are not a limitation to the present invention. The connections among these elements are described below.

The gate 305*c* of the third TFT 305 is electrically coupled to the first input terminal Vin and the drain 305*a* thereof. The gate 307*c* of the fourth TFT 307 is electrically coupled to the gate 305*c* of the third TFT 305. The source 307*b* of the fourth TFT 307 is electrically coupled to the gate 301*c* of the first TFT 301. The drain 307*a* of the fourth TFT 307, electrically coupled to the source 305*b* of the third TFT 305, receives the feedback signal 304.

The gate 309*c* of the fifth TFT 309 is electrically coupled to the second input terminal Vxin and the drain 309*a* of the fifth TFT 309. The source 309*b* of the fifth TFT 309, electrically coupled to the gate 303*c* of the second TFT 303, transmits the second switching control signal 302. The gate 311*c* of the sixth TFT 311 is electrically coupled to the first input terminal Vin. The source 311*b* of the sixth TFT 311 is electrically coupled to the gate 303*c* of the second TFT 303 and the source 309*b* of the fifth TFT 309. The drain 311*a* of the sixth TFT 311 is electrically coupled to the second power supply terminal $V_{SS}$.

The source 313*b* of the seventh TFT 313 is electrically coupled to the gate 301*c* of the first TFT 301. The source 315*b* of the eighth TFT 315, electrically coupled to the drain 313*a* of the seventh TFT 313, receives the feedback signal 306. The gate 315*c* of the eighth TFT 315 and the gate 313*c* of the seventh TFT 313, electrically coupled to the gate 303*c* of the second TFT 303, receive the second switching control signal 302. The drain 315*a* of the eighth TFT 315 is electrically coupled to the second power supply terminal $V_{SS}$. In other words, the eighth TFT 315 receives the second switching control signal 302.

The gate 317*c* of the ninth TFT 317 is electrically coupled to the output terminal Vout and the drain 317*a* of the ninth TFT 317. The source 317*b* of the ninth TFT 317, electrically coupled to the source 305*b* of the third TFT 305, provides the feedback signal 304. The source 319*b* of the tenth TFT 319, electrically coupled to drain 313*a* of the seventh TFT 313 and the source 315*b* of the eighth TFT 315, provides the feedback signal 306. The gate 319*c* of the tenth TFT 319 is electrically coupled to the output terminal Vout and the drain 319*a* of the tenth TFT 319.

Figure 3B:
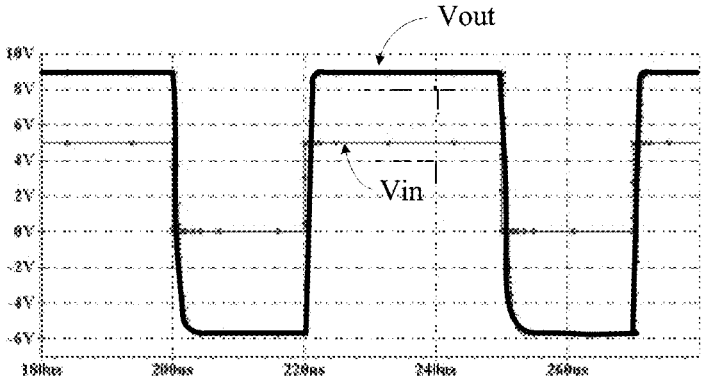
FIGS. 3B, 3C, and 3D illustrate waveforms of an input terminal and an output terminal of the second embodiment of the present invention.
Figure 3C:
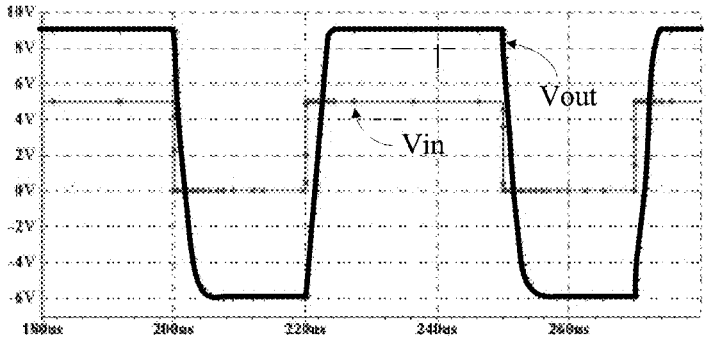
Figure 3D:
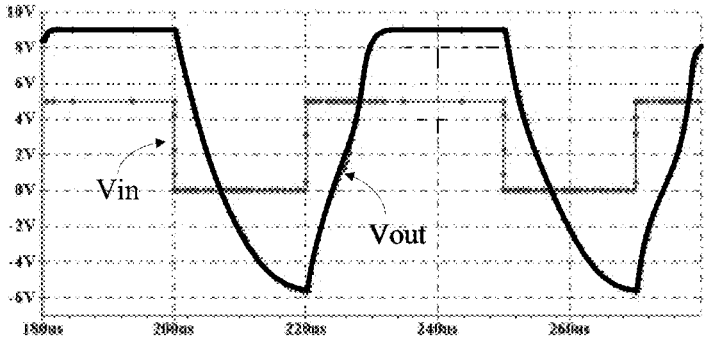

FIGS. 3B, 3C, and 3D show simulation voltage versus time waveforms of the first input terminal Vin and the output terminal Vout under three different TFT threshold voltages in accordance to the second embodiment, respectively. FIG. 3B shows the waveforms under a first threshold voltage, substantially −1V, FIG. 3C shows the waveforms under a second threshold voltage, substantially −2.5V, and FIG. 3D shows the waveforms under a third threshold voltage, substantially −4V. Meanwhile, the simulation conditions for deriving the waveforms in FIGS. 3B, 3C, and 3D are that: the first power supply terminal $V_{DD}$ is substantially equal to −6V, the second power supply terminal $V_{SS}$ is substantially equal to 9V, the first input terminal Vin swings from about 0V to about 5V, the electron mobility of the PMOS TFTs is about 60 $cm^2$/Vsec, and an output load has about 20 pF capacitance.

As shown in FIG. 3B, the low level of the output terminal Vout is close to the voltage level of the first power supply $V_{DD}$ when the threshold voltage is about −1V. As shown in FIG. 3C, the low level and high level of the output terminal Vout are more acceptable when the threshold voltage of TFT is about −2.5V. As shown in FIG. 3D, the output signal of the output terminal Vout still requires long time to reach the low level and the high level when the threshold voltage of TFT is about −4V.

Figure 4A:
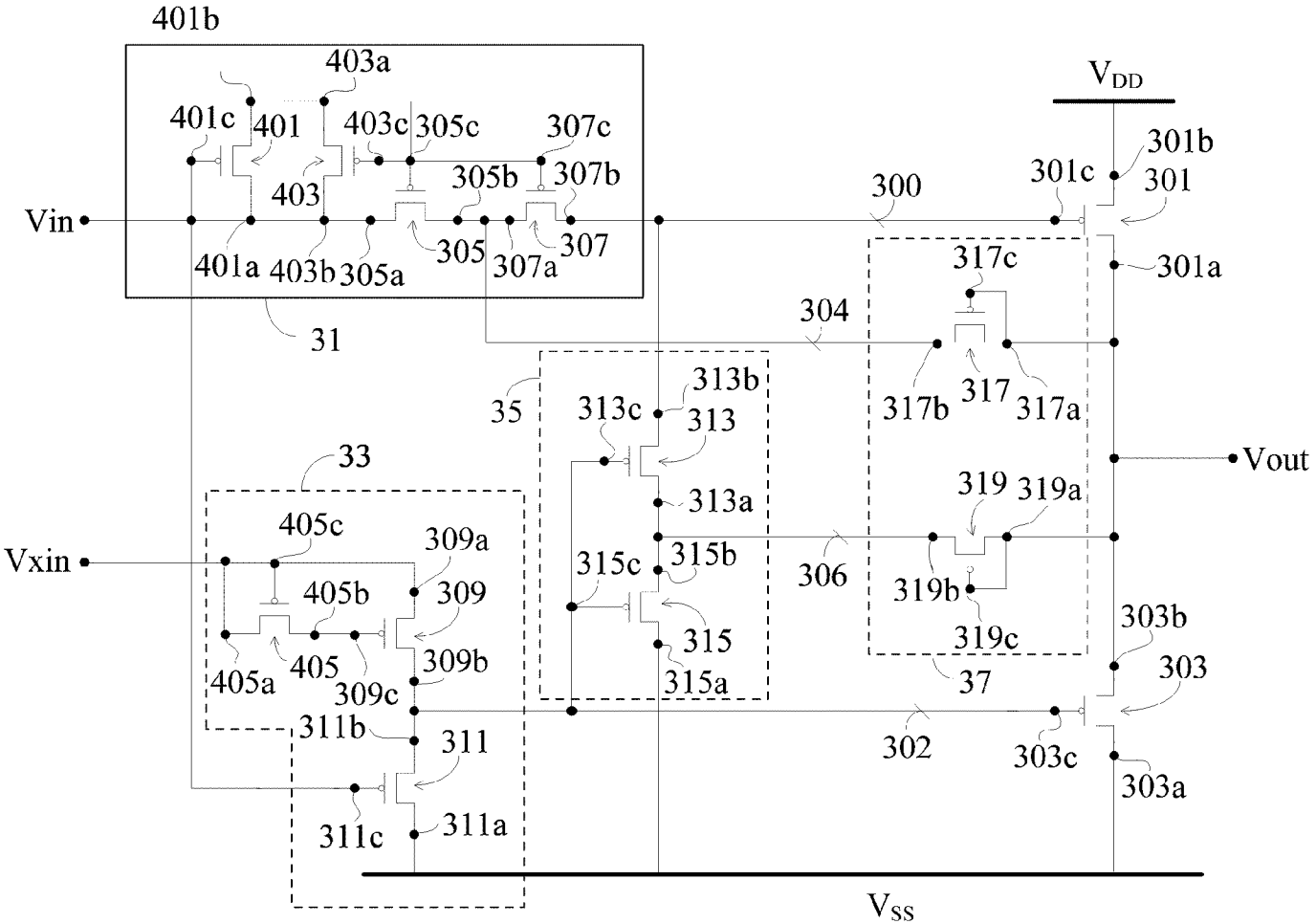
FIG. 4A illustrates a third embodiment of the present invention.

FIG. 4A shows a third embodiment of the present invention. In contrast to the second embodiment, the first input unit 31 and the second input unit 33 of the third embodiment are different. As FIG. 4A shows, the first input unit 31 further comprises an eleventh TFT 401 and a twelfth TFT 403, and the second input unit 33 further comprises a thirteenth TFT 405. The connections among these elements are described below.

The drain 305*a* of the third TFT 305 is electrically coupled to the first input terminal Vin, the source 307*b* of the fourth TFT 307 is electrically coupled to the gate 301*c* of the first TFT 301 and the disable unit 35. The gate 307*c* of the fourth TFT 307 is electrically coupled to the gate 305*c* of the third TFT 305. The gate 307*a* of the fourth TFT 307 is electrically coupled to the source 305*b* of the third TFT 305. The gate 401*c* of the eleventh TFT 401 is electrically coupled to the first input terminal Vin and the second input unit 33. The drain 401*a* of the eleventh TFT 401 is electrically coupled to the first input terminal Vin. The gate 401*b* of the eleventh TFT 401 is electrically coupled to the gate 307*c* of the fourth TFT 307. The gate 403*c* of the twelfth TFT 403 is electrically coupled to the gate 305*c* of the third TFT 305. The source 403*b* of the twelfth TFT 403 is electrically coupled to the first input terminal Vin. The drain 403*a* of the twelfth TFT 403 is electrically coupled to the gate 305*c* of the third TFT 305.

The source 309*b* of the fifth TFT 309 is electrically coupled to the gate 303*c* of the second TFT 303. The drain 309*a* of the fifth TFT 309 is electrically coupled to the second input terminal Vxin. The gate 311*c* of the sixth TFT 311 is electrically coupled to the first input terminal Vin. The drain 311*a* of the sixth TFT 311 is electrically coupled to the second power supply terminal $V_{SS}$. The source 311*b* of the sixth TFT 311 is electrically coupled to the gate 303*c* of the second TFT 303. The gate 405*c* of the thirteenth TFT 405 is electrically coupled to the second input terminal Vxin. The source 405*b* of the thirteenth TFT 405 is electrically coupled to the gate 309*c* of the fifth TFT 309. The drain 405*a* of the thirteenth TFT 405 is electrically coupled to the second input terminal Vxin.

The rest connections of the elements in the third embodiment are similar to those in the second embodiment so they are not repeated herein.

Figure 4B:
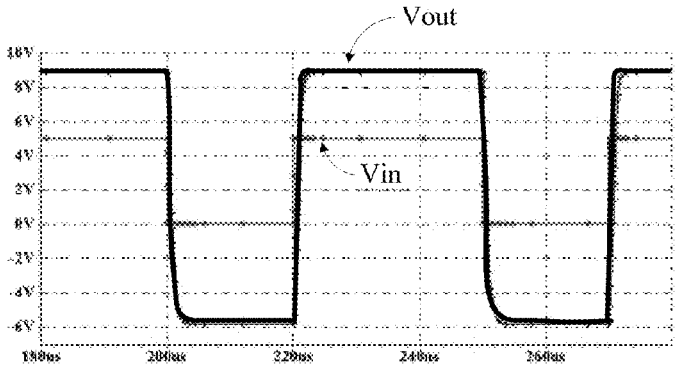
FIGS. 4B, 4C, and 4D illustrate waveforms of an input terminal and an output terminal of the third embodiment of the present invention.
Figure 4C:
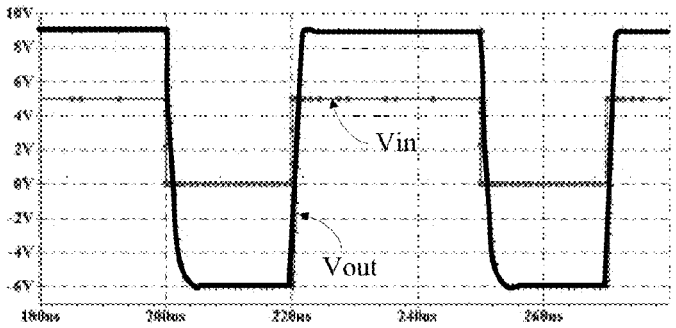
Figure 4D:
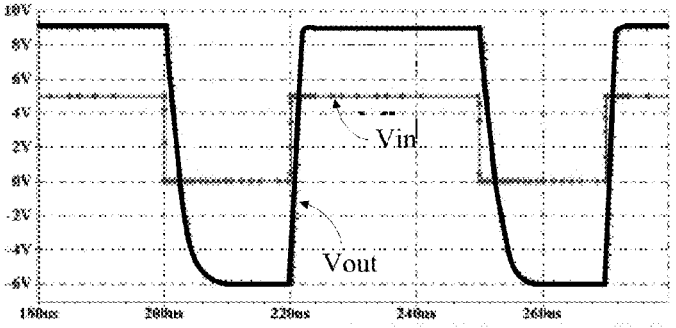

The eleventh TFT 401 and the twelfth TFT 403 cause a Bootstrap effect. They, as well as the thirteenth TFT 405 of the second input unit 33, are capable of improving the performance of the whole circuit. FIGS. 4B, 4C, and 4D show simulation voltage versus time waveforms of the first input terminal Vin and the output terminal Vout under three different TFT threshold voltages in accordance to the third embodiment, respectively. FIG. 4B shows the waveforms under a first threshold voltage, substantially −1V, FIG. 4C shows the waveforms under a second threshold voltage, substantially −2.5V, and FIG. 4D shows the waveforms under a third threshold voltage, substantially −4V. Meanwhile, the simulation conditions for deriving the waveforms in FIGS. 4B, 4C, and 4D are that: the first power supply terminal $V_{DD}$ is substantially equal to −6V, the second power supply terminal $V_{SS}$ is substantially equal to 9V, the first input terminal Vin swings from about 0V to about 5V, the electron mobility of the PMOS TFTs is about 60 $cm^2$/Vsec, and an output load has about 20 pF capacitance. One can observe that the waveforms of the output terminal Vout are excellent no matter the threshold voltage is low or high.

Figure 5A:
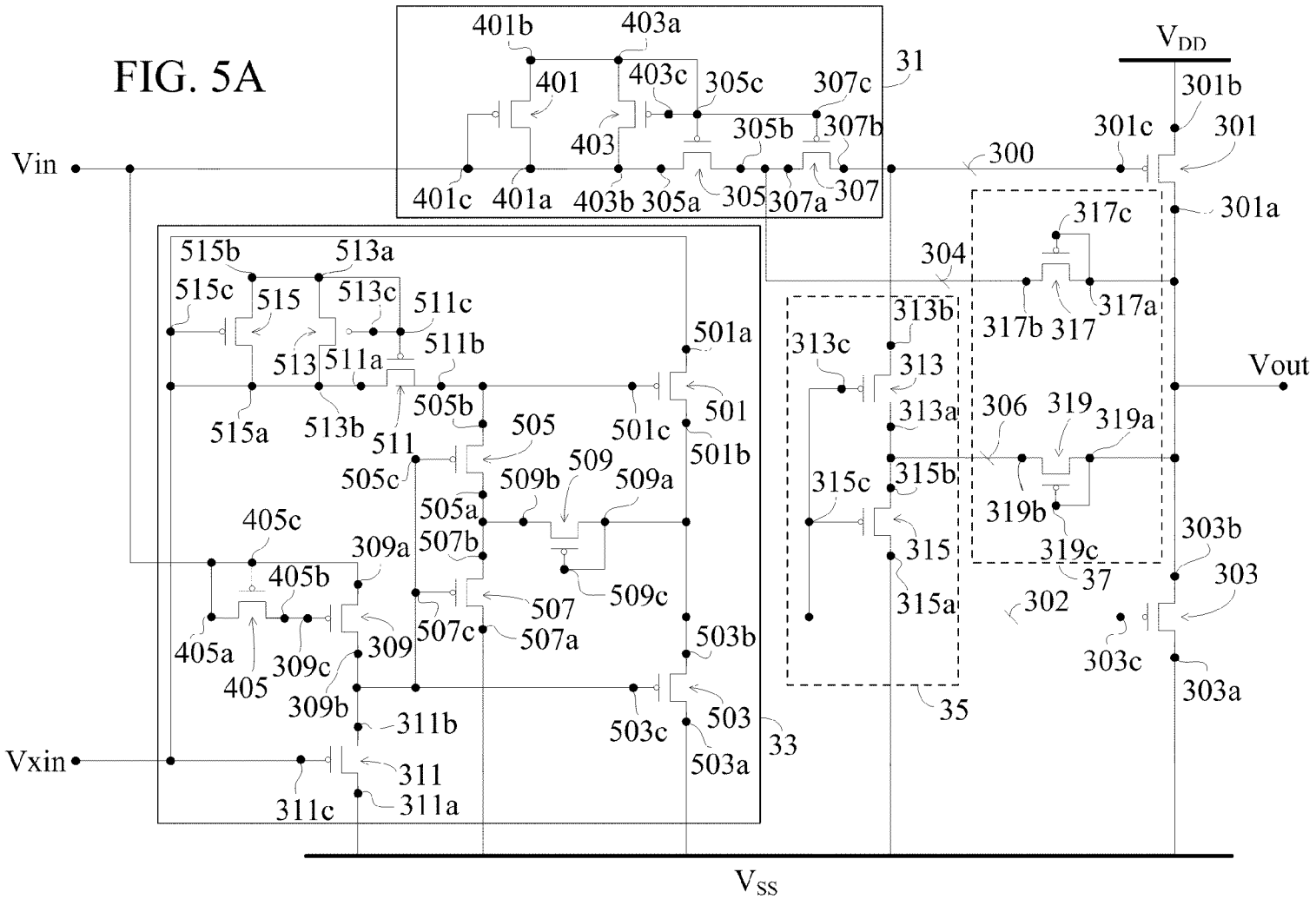
FIG. 5A illustrates a fourth embodiment of the present invention.

FIG. 5A shows a fourth embodiment of the present invention. In contrast to the third embodiment, the second input unit 33 of the fourth embodiment is modified. The second input unit 33 further comprises a fourteenth TFT 501, a fifteenth TFT 503, a sixteenth TFT 505, a seventeenth TFT 507, an eighteenth TFT 509, a nineteenth TFT 511, a twentieth TFT 513, and a twenty-first TFT 515. All of the TFTs are P-type. The connections among those elements in the second input unit 33 are described below.

The drain 309*a* of the fifth TFT 309 is electrically coupled to the first input terminal Vin. The gate 311*c* of the sixth TFT 311 is electrically coupled to the second input terminal Vxin. The source 311*b* of the sixth TFT 311 is electrically coupled to the source 309*b* of the fifth TFT 309. The drain 311*a* of the sixth TFT 311 is electrically coupled to the second power supply terminal $V_{SS}$. The gate 405*c* of the thirteenth TFT 405 is electrically coupled to the first input terminal Vin. The source 405*b* of the thirteenth TFT 405 is electrically coupled to the gate 309*c* of the fifth TFT 309. The drain 405*a* of the thirteenth TFT 405 is electrically coupled to the first input terminal Vin.

The drain 501*a* of the fourteenth TFT 501 is electrically coupled to the second input terminal Vxin. The source 501*b* of the fourteenth TFT 501 is coupled to the gate 303*c* of the second TFT 303. The source of 503*b* the fifteenth TFT 503 is electrically coupled to the gate 303*c* of the second TFT 303. The drain 503*a* of the fifteenth TFT 503 is electrically coupled to the second power supply terminal $V_{SS}$. The gate 503*c* of the fifteenth TFT 503 is electrically coupled to the source 309*b* of the fifth TFT 309. The source 505*b* of the sixteenth TFT 505 is electrically coupled to the gate 501*c* of the fourteenth TFT 501. The gate 505*c* of the sixteenth TFT 505 is electrically coupled to the source 309*b* of the fifth TFT 309. The gate 507*c* of the seventeenth TFT 507 is electrically coupled to the gate 505*c* of the sixteenth TFT 505. The drain 507*a* of the seventeenth TFT 507 is electrically coupled to the second power supply terminal $V_{SS}$. The source 507*b* of the seventeenth TFT 507 is electrically coupled to the drain 505*a* of the sixteenth TFT 505. The gate 509*c* of the eighteenth TFT 509 is electrically coupled to the source 501*b* of the fourteenth TFT 501 and the drain 509*a* of the eighteenth TFT 509. The source 509*b* of the eighteenth TFT 509 is electrically coupled to the drain 505*a* of the sixteenth TFT 505. The source 511*b* of the nineteenth TFT 511 is electrically coupled to the source 505*b* of the sixteenth TFT 505. The gate 513*c* of the twentieth TFT 513 is electrically coupled to the gate 511*c* of the nineteenth TFT 511 and the drain 513*a* of the twentieth TFT 513. The source 513*b* of the twentieth TFT 513 is electrically coupled to the drain 511*a* of the nineteenth TFT 511 and the second input terminal Vxin. The gate 515*c* and the drain 515*a* of the twenty-first TFT 515 are electrically coupled to the second input terminal Vxin. The source 515*b* of the twenty-first TFT 515 is electrically coupled to the drain 513*a* of the twentieth TFT 513.

The rest connections of the elements in the fourth embodiment are identical to those of the third embodiment so they are not repeated herein.

Figure 5B:
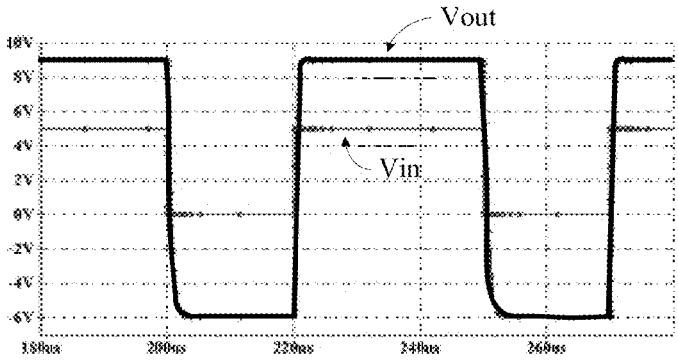
FIGS. 5B, 5C, and 5D illustrate waveforms of an input terminal and an output terminal of the fourth embodiment of the present invention.
Figure 5C:
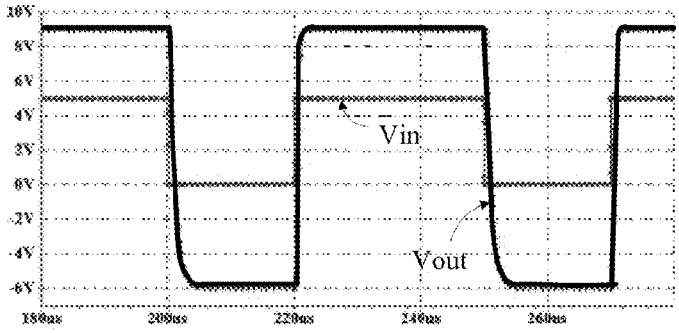
Figure 5D:
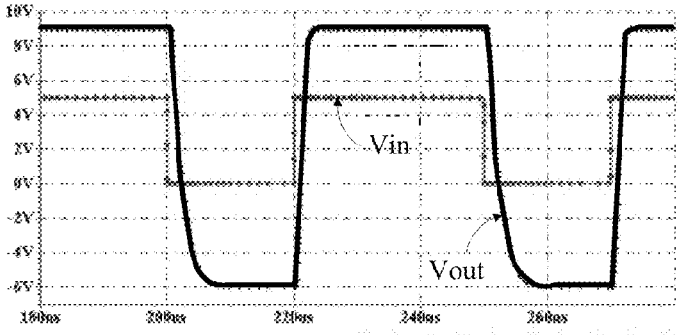

FIGS. 5B, 5C, and 5D show simulation voltage versus time waveforms of the first input terminal Yin and the output terminal Vout under three different TFT threshold voltages in accordance to the fourth embodiment, respectively. FIG. 5B shows the waveforms under a first threshold voltage, substantially −1V, FIG. 5C shows the waveforms under a second threshold voltage, substantially −2.5V, and FIG. 5D shows the waveforms under a third threshold voltage, substantially −5V. Meanwhile, the simulation conditions for deriving the waveforms in FIGS. 5B, 5C, and 5D are that: the first power supply terminal $V_{DD}$ is substantially equal to −6V, the second power supply terminal $V_{SS}$ is substantially equal to 9V, the first input terminal Vin swings from about 0V to about 5V, the electron mobility of the PMOS TFTs is about 60 $cm^2$/Vsec, and an output load has about 20 pF capacitance. One can observe that the waveforms of the output terminal Vout are excellent no matter the threshold voltage is low or high.

Table 1 shows the currents flowing through the first power supply terminal $V_{DD}$ of third embodiment and fourth embodiment under the different threshold voltages. One can observe that the current flowing through $V_{DD}$ of the fourth embodiment is apparently smaller than that of the third embodiment. Therefore, the fourth embodiment saves more power.

TABLE 1

| Threshold voltage of TFT (V) | Current flowing through the first power supply terminal of third embodiment (μA) | Current flowing through the first power supply terminal of fourth embodiment (μA) |
|---|---|---|
| −1 | 58.0 | 13.5 |
| −2 | 8.5 | 5.2 |
| −3 | 3.3 | 1.8 |
| −4 | 1.3 | 0.5 |

The present invention discloses voltage level shifters formed by single-typed TFTs. When integrating the voltage level shifters into a substrate of a TFT display, the manufacturing processes are simplified. Besides, power is saved.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A voltage level shifter, comprising:

a first input terminal for receiving a first input signal;

a second input terminal for receiving a second input signal;

an output terminal;

a first power supply terminal;

a second power supply terminal;

a first input unit for receiving the first input signal so as to output a first switching control signal;

a first TFT for receiving the first switching control signal, wherein the first TFT has a gate electrically coupled to the first input unit, a source electrically coupled to the first power supply terminal, and a drain electrically coupled to the output terminal;

a second input unit, electrically coupled to the second power supply terminal, for receiving the second input signal and outputting a second switching control signal;

a disable unit for disabling the first TFT and comprising:

a seventh TFT having a source electrically coupled to the gate of the first TFT and the first input unit, a drain, and a gate; and an eighth TFT having a source electrically coupled to the drain of the seventh TFT, a drain electrically coupled to the second power supply terminal, and a gate for electrically coupled to the second input unit and receiving the second switching control signal from the second input unit;

a feedback unit for transmitting a feedback signal to the first input unit and the disable unit in response to an output signal of the output terminal; and a second TFT for receiving the second switching control signal, wherein the second TFT has a gate electrically coupled to the second input unit, the gate of the seventh TFT, and the gate of the eighth TFT, a source electrically coupled to the output terminal, and a drain electrically coupled to the second power supply terminal.

2. The voltage level shifter of claim 1, wherein the first input signal and the second input signal are inverted.

3. The voltage level shifter of claim 1, wherein the output signal of the output terminal and the first input signal are non-inverted.

4. The voltage level shifter of claim 1, wherein the first power supply terminal provides a negative level voltage and the second power supply terminal provides a positive level voltage.

5. The voltage level shifter of claim 4, wherein the negative voltage is substantially −6V and the positive voltage is substantially 9V.

6. The voltage level shifter of claim 1, wherein the second input unit comprises:

a fifth TFT having a source electrically coupled to the gate of the second TFT, a drain, and a gate electrically coupled to the second input terminal and the drain thereof; and a sixth TFT having a gate electrically coupled to the first input terminal, a source electrically coupled to the gate of the second TFT, and a drain electrically coupled to the second power supply terminal.

7. The voltage level shifter of claim 1, wherein the second input unit comprises:

a fifth TFT having a source electrically coupled to the gate of the second TFT, a drain electrically coupled to the second input terminal, and a gate;

a sixth TFT having a gate electrically coupled to the first input terminal, a source electrically coupled to the gate of the second TFT, and a drain electrically coupled to the second power supply terminal; and a thirteenth TFT having a gate electrically coupled to the second input terminal, a source electrically coupled to the gate of the fifth TFT, and a drain electrically coupled to the second input terminal.

8. The voltage level shifter of claim 1, wherein the disable unit is directly electrically coupled to the second input unit.

9. A voltage level shifter, comprising:

a first input terminal for receiving a first input signal;

a second input terminal for receiving a second input signal;

an output terminal;

a first power supply terminal for providing a power;

a second power supply terminal for providing another power, wherein the power of the first power supply terminal is different with the another power of the second power supply terminal;

a first input unit for receiving the first input signal so as to output a first switching control signal;

a first TFT for receiving the first switching control signal, wherein the first TFT has a gate electrically coupled to the first input unit, a source electrically coupled to the first power supply terminal, and a drain electrically coupled to the output terminal;

a second input unit, electrically coupled to the second power supply terminal, for receiving the second input signal and outputting a second switching control signal;

a disable unit for disabling the first TFT and comprising:

a seventh TFT having a source electrically coupled to the gate of the first TFT and the first input unit, a drain, and a gate; and an eighth TFT having a source electrically coupled to the drain of the seventh TFT, a drain electrically coupled to the second power supply terminal and receiving the another power from the second power supply terminal, and a gate for electrically coupled to the second input unit;

a feedback unit for transmitting a feedback signal to the first input unit and the disable unit in response to an output signal of the output terminal; and a second TFT for receiving the second switching control signal, wherein the second TFT has a gate electrically coupled to the second input unit, the gate of the seventh TFT, and the gate of the eighth TFT, a source electrically coupled to the output terminal, and a drain electrically coupled to the second power supply terminal.

10. The voltage level shifter of claim 9, wherein the disable unit is directly electrically coupled to the second power supply terminal.

11. The voltage level shifter of claim 9, wherein the first input signal and the second input signal are inverted.

12. The voltage level shifter of claim 9, wherein the output signal of the output terminal and the first input signal are non-inverted.

13. The voltage level shifter of claim 9, wherein the first power supply terminal provides a negative level voltage and the second power supply terminal provides a positive level voltage.

14. The voltage level shifter of claim 13, wherein the negative voltage is substantially −6V and the positive voltage is substantially 9V.

15. The voltage level shifter of claim 9, wherein the second input unit comprises:

a fifth TFT having a source electrically coupled to the gate of the second TFT, a drain, and a gate electrically coupled to the second input terminal and the drain thereof; and a sixth TFT having a gate electrically coupled to the first input terminal, a source electrically coupled to the gate of the second TFT, and a drain electrically coupled to the second power supply terminal.

16. The voltage level shifter of claim 9, wherein the second input unit comprises:

a fifth TFT having a source electrically coupled to the gate of the second TFT, a drain electrically coupled to the second input terminal, and a gate;

a sixth TFT having a gate electrically coupled to the first input terminal, a source electrically coupled to the gate of the second TFT, and a drain electrically coupled to the second power supply terminal; and a thirteenth TFT having a gate electrically coupled to the second input terminal, a source electrically coupled to the gate of the fifth TFT, and a drain electrically coupled to the second input terminal.

* * * * *